US006268805B1

(12) United States Patent
Simon

(10) Patent No.: US 6,268,805 B1
(45) Date of Patent: Jul. 31, 2001

(54) TRAFFIC LIGHT

(76) Inventor: Damon Undrell Simon, 2023 Chanslor Ave., Apt. 3, Richmond, CA (US) 94801

( * ) Notice: Subject to any disclaimer, the term of this patent is extended or adjusted under 35 U.S.C. 154(b) by 0 days.

(21) Appl. No.: 09/452,897

(22) Filed: Dec. 1, 1999

(51) Int. Cl.[7] ..... G08G 1/095

(52) U.S. Cl. ..... 340/907; 340/929; 340/930; 340/944; 340/309.15

(58) Field of Search ..... 340/907, 929, 340/930, 944, 309.15, 332

(56) References Cited

U.S. PATENT DOCUMENTS 5,726,648 * 3/1998 Soon ..... 340/929

* cited by examiner

*Primary Examiner*—Daryl Pope
(74) *Attorney, Agent, or Firm*—Risto A. Rinne, Jr.

(57) ABSTRACT

An apparatus for the control of traffic includes a signal assembly with a red stop light, a green passage light, and a yellow caution light. A count-down indicator includes a digital display that displays (i.e., counts down) the remaining time in seconds until the next signal change occurs. The digital display matches the color of the digits being displayed to that of the illumined light of the signal assembly. The count-down indicator includes a battery backup assembly that includes an optional backup battery that permits functioning of the traffic signal during power outages. An optional solar panel economically helps maintain the charge of the backup battery. A microprocessor in the battery backup assembly receives information from the signal assembly, processes that information, and controls the digital display parameters. If the signal assembly relies upon traffic sensors and can abruptly change the remaining time that is being shown by the digital display, the digits of the digital display flash to inform a driver of this potentiality. According to a modification, a flashing caution light is attached to the digital display and it flashes whenever there is potential that the remaining time can suddenly change in a manner that violates the normal count-down sequence.

18 Claims, 1 Drawing Sheet

TRAFFIC LIGHT

BACKGROUND OF THE INVENTION

1. Field of the Invention

The present invention, in general relates to traffic lights and, more particularly, to devices that show the remaining time until a traffic light changes its signal.

Traffic lights are well known devices. Traffic lights that indicate the remaining time until a change occurs are also known to a limited degree. However, these prior devices fail to solve certain needs, and may even create new problems.

There is a need to indicate the remaining time until a traffic light changes its indication. If an approaching driver sees a red light, speeds up to it, stops abruptly, and then has the light turn green, he then accelerates briskly and drives off. This wastes energy.

If the driver instead knew that there were only 5 seconds remaining until it turned green he could, for example, take his foot off of the accelerator pedal and coast for a few seconds waiting for it to turn green, and then upon verifying that the intersection was indeed clear, begin to accelerate, or simply maintain speed. This would save energy.

However, there is a problem created by traffic lights that indicate the remaining time until the next signal change, that is from green to yellow, yellow to red, or red to green.

Traffic lights are color coded. Red means stop. Green means go and yellow means clear the intersection. As a result, drivers become habituated to certain colors and develop a strong association to the color that they see. The colors meaning certain things. They may in fact not fully notice the light itself, but rather possess an overall awareness of the color of the light that is before them and respond accordingly.

If a traffic light was, for example, to indicate the remaining time until the next signal change and do so with red numerals, then over time the driver would begin to falsely associate the color red with a go indication, rather than a stop indication. This would occur if, for example, the red numerals indicated that there were fifteen seconds of green (or go) time remaining. The driver would be exposed to contradictory visual data, seeing a green light and a red "15" seconds of time remaining in close proximity thereto.

As a result, a traffic light that counts down the time can result in desensitizing the driver to the color of the signal itself. It is not hard to understand how a desensitization to the color red can have highly deleterious effects, so much so that the various administrative agencies that select the kinds of traffic signals that are used would abstain from using such kinds of count-down devices, for fear of causing accidents.

Another problem with count-down types of traffic lights is that the duty cycle (i.e., the time the light is green as compared to red) will vary depending upon the time of day and traffic patterns. For example, a 30 second green period followed by a 30 second red period may be appropriate during normal times of the day for a particular intersection. However, during peak commuter times, a 45 second green and 15 second red time may be more appropriate.

A count-down light must be adaptable to function with such changes.

Another problem occurs with on-demand types of traffic lights that include a normal duty cycle but are able to override the normal duty cycle based on the immediate traffic flow. For example, if there are thirty seconds of green time remaining and there is no traffic passing through the intersection while cars are waiting at a red light to cross in a perpendicular direction, many modern traffic lights will detect this condition and curtail the thirty second countdown to only a few seconds before changing.

Obviously, a countdown indicator that is reading thirty seconds of green time remaining could mislead a motorist if is suddenly changed, without warning, to five seconds of remaining green time as a result of a change due to the demand pattern of the traffic.

Also, traffic lights, in general are subject to a supply of electrical power supplied by the local utility company. A disruption in electrical power causes traffic lights to cease to operate. This often occurs when the neighborhood is itself dark, as a result of the electrical power failure. It is desirable that traffic lights continue to function during such times so as to allow for the proper, controlled flow of traffic and also to foster feelings of safety among drivers and residents during power failures.

Accordingly there exists today a need for a traffic light that indicates the remaining time until a signal change is to occur, does not desensitize the driver to any particular color, is adaptable for use with variable duty cycle traffic lights, is adaptable for use with on-demand types of traffic lights, and is useful during power outages.

Clearly, such an apparatus would be a useful and desirable device.

2. Description of Prior Art

Traffic lights are, in general, known. For example, the following patents describe various types of these devices:

U.S. Pat. No. 3,234,506 to Hines, Feb. 8, 1966;

U.S. Pat. No. 3,320,585 to Hines, May 16, 1967;

U.S. Pat. No. 3,480,909 to Hines, Nov. 25, 1969;

U.S. Pat. No. 5,150,116 to West, Sep. 22, 1992;

U.S. Pat. No. 5,726,648 to Soon, Mar. 10, 1998; and

U.S. Design Pat. No. 314,524 to Perry, Feb. 12, 1991.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a traffic light that reveals the remaining time until a change is to occur in its state.

It is also an important object of the invention to provide a traffic light that displays the remaining time in a color that matches that of the traffic light.

Another object of the invention is to provide a traffic light that displays the remaining stop time in red digits.

Still another object of the invention is to provide a traffic light that displays the remaining caution time in yellow (or orange) digits.

Still yet another object of the invention is to provide a traffic light that displays the remaining go or proceed time in green digits.

Yet another important object of the invention is to provide a traffic light that includes a battery backup.

Still yet another important object of the invention is to provide a traffic light that includes a solar powered battery backup.

Still yet one other important object of the invention is to provide a traffic light that is adaptable for use with variable time traffic lights.

Still yet one other important object of the invention is to provide a traffic light that is adaptable for use with on-demand types of traffic lights.

Briefly, a traffic light apparatus for use in the control of the flow of traffic that is constructed in accordance with the principles of the present invention has a numeric display attached proximate to a conventional type of a traffic light to indicate the remaining time until the next change in signal control (i.e., for example, the remaining time the light will be red) in a color that corresponds with that of the conventional type of a traffic light, such as in red digits when the light is signaling a stop condition, yellow or orange when it is signaling a caution condition, and green when it is signaling a go condition. The traffic light apparatus is adapted for use with "on-demand" types of traffic lights and the display is varied to indicate the presence of such a condition including the use of an optional flashing caution indicator. An optional solar panel and battery backup provide operation during power outages.

DETAILED DESCRIPTION OF THE INVENTION

Figure 1:
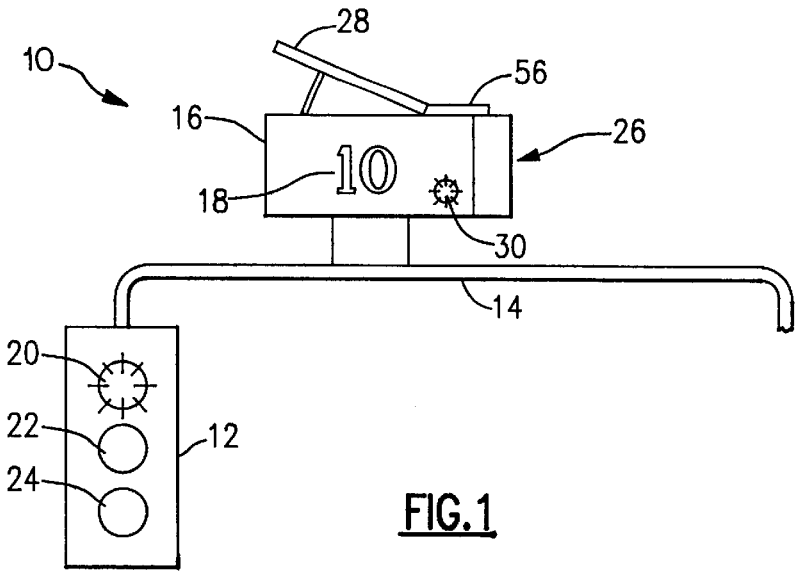
FIG. 1 is a side view of a traffic light.

Referring to FIG. 1 is shown, a traffic light, identified in general by the reference numeral 10. The traffic light 10 includes a conventional type of a traffic signal assembly 12 that illuminates a red light 20 for stop, a yellow light 22 (or orange) for caution, and a green light 24 for passage (i.e., "go").

The traffic light 10 is shown attached to a support pole 14 that is only partially shown. A count-down indicator 16 is affixed proximate to the signal assembly 12.

The count-down indicator 16 includes a digital display 18 of the number of seconds remaining until the signal assembly 12 changes its current state.

In the FIG. 1 drawing, the red stop light 20 is illuminated. The yellow caution light 22 and the green passage light 24 are off. The digital display 18 of the count-down indicator 16 is showing that ten seconds remain until the red light 20 of the signal assembly 12 turns off and the green passage light 24 illuminates.

As soon as one second passes, the digital display 18 of the count-down indicator 16 would change from "10" to "9" to show that now only nine more seconds of illuminating the red stop light 20 remain until the next change of state for the signal assembly 12 occurs.

This process repeats until only one second remains and the digital display 18 of the count-down indicator 16 reads "one" for a duration of one second remaining. Then, when the last second elapses, the red stop light 20 turns off and the green passage light 24 illuminates. At that time the digital display 18 of the count-down indicator changes as well to now indicate the remaining amount of time that the green passage light 24 will be illuminated.

If for example, the green passage light 24 will be on for a total of thirty seconds, the digital display 18 of the count-down indicator 16 would change from "1" to "30".

Attached to the count-down indicator 16 is a control logic and battery backup assembly, identified in general by the reference numeral 26.

Figure 2:
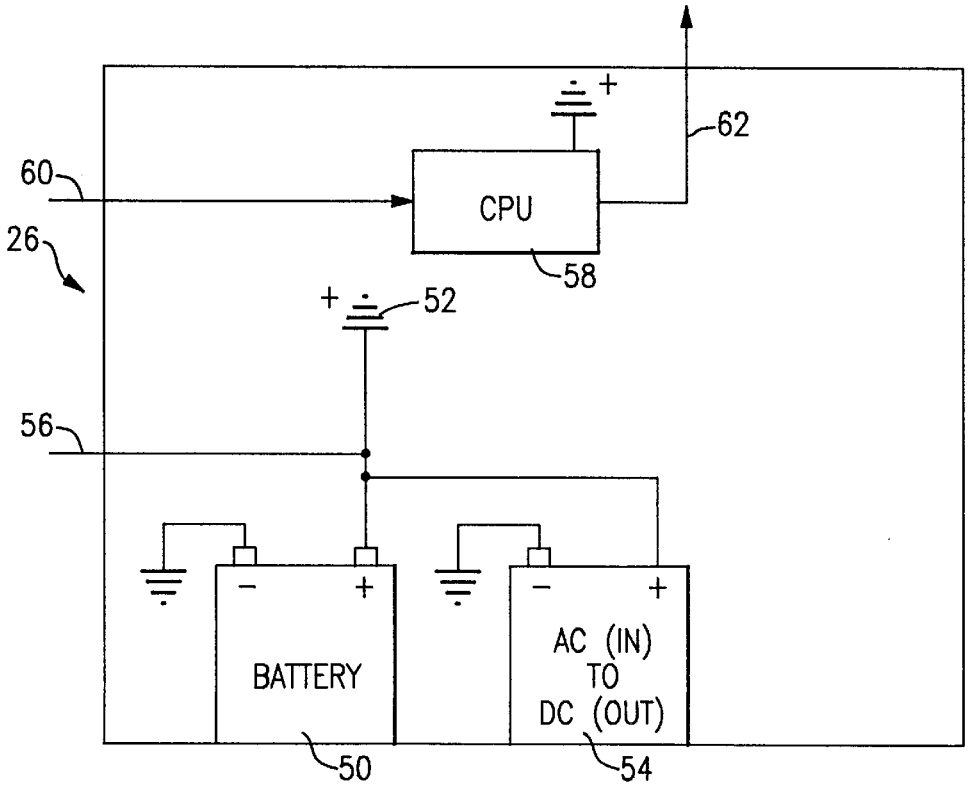
FIG. 2 is a block diagrammatic view of the control logic and battery backup assembly of FIG. 1.

Referring on occasion also to FIG. 2, the control logic and battery backup assembly 26 includes a backup battery 50. The backup battery 50 functions during power interruptions to control the traffic light, as is described in greater detail hereinafter.

The backup battery 50 includes a DC voltage output 52 that is used to supply electrical power to the count-down indicator and in general to the traffic light 10.

As is well known in the electrical arts, a power supply 54 converts electrical AC power supplied to it into a direct current output that is supplied to the backup battery 50 and serves to keep it fully charged during normal use.

Referring momentarily to FIG. 1, a solar panel 28 is attached where desired to the traffic light 10 and, in this embodiment, to the count-down indicator 16 where it converts solar radiation into electrical power and supplies a solar output 56 (FIG. 2) to help charge the backup battery 50.

A microprocessor 58 (also known as a Central Processor Unit or CPU) in the control logic and battery backup assembly 26 receives an input signal 60 from a logic circuit (not shown) of the signal assembly 12.

The input signal 60 informs the microprocessor 58 of the state of the signal assembly 12, such as whether it is indicating a stop, caution, or proceed condition for a particular direction and the remaining time until that state or condition changes.

The input signal 60 also informs the microprocessor 58 as to the operating mode of the signal assembly 12, as is described in greater detail hereinbelow.

The microprocessor 58 in turn uses (i.e., processes) the input signal 60 to supply a control signal 62 to the count-down indicator 16. The control signal 62 includes all data or control signals necessary to properly control the functions of the count-down indicator 16 and the digital display 18.

An important object of the traffic light 10 is to match the color of the digital display 18 to that of the color of the light (i.e., either red 20, yellow 22, or green 24). The control signal 62 is used to set the digital display 18 to both the amount of time remaining until a change occurs and also to the color of the light (20, 22, 24).

If, for example, fifteen seconds of the red stop light 20 remain, the digital display 18 will indicate "15" in red digits. This is to maintain consistency between the important color codes that are associated with traffic control systems and the additional helpful data that is provided by the traffic light 10.

If however, fifteen seconds of the green passage light 24 remain, the digital display 18 will then indicate "15" in green digits.

If three seconds of the yellow caution light 22 remain, the digital display 18 will indicate "3" in yellow digits.

There are many ways to control the color of digits of the digital display 18 that are well known in the electrical and electronic display arts, and they are not individually described in detail herein.

One common way is briefly described and that is by the use of a matrix of red, green, and yellow light emitting diodes (LEDs). If red digits in the digital display 18 are to be shown then only the red LEDs are illuminated so as to form the digit or digits. If green or yellow digits are desired, then respectively only green or yellow LEDs are illuminated.

Another common way that involves using a white light source and the variable use of colored filter screens as another well known method to vary the color of the digits that are being displayed is also presently noted.

Any preferred method is acceptable for use by the digital display 18 to match the color of the digits being displayed with the color of the presently illumined light 20–24 of the signal assembly 12.

Incorporating a count-down indicator 16 that includes a digital display 18 that matches, in color, the color of light (20–24) of the signal assembly 12 contributes to improving safety.

In addition to providing the driver with useful information that can ease the flow of traffic and save energy the driver is also visually exposed to a redundant source of color-coded information as to the state of the signal assembly 12 and is therefore more likely to notice the present state of the traffic light 10. This can reduce the frequency by which drivers fail to notice that the red stop light 20 is illumined, for example, and whom might, therefore, pass through the intersection inappropriately. This will, in turn, decrease the number of accidents between vehicles and also between vehicles that collide with pedestrians.

As a result, property damage will be reduced and lives will be saved. Energy will also be saved because drivers are afforded the information that is necessary for them to optimally moderate their deceleration and acceleration, thereby saving fuel as well as reducing the amount of vehicular wear and tear that occurs. For example, the useful life expectancy of brake components (not shown) such as brake shoes would be increased as a result of the decreased use and reliance upon the braking system of the vehicle.

The duty cycle of the signal assembly 12 may change to accommodate traffic requirements during peak commuter times. For example, if the normal duration for the green passage light 24 is thirty seconds of on time, the duration of this on time may increase to forty seconds of the green passage light 24 being illumined (with or without any change in the red or yellow times) to accommodate peak traffic requirements, such as during peak commute times of the day.

The present time, whatever it may be, is furnished to the microprocessor 58 through information supplied by the input signal 60. For most changes of this kind affecting only the duty cycle, no change is required in the digital display 18 of the count-down indicator 16 other than to display the "then-current" time remaining until the next signal change occurs.

In the above example (i.e., changing from 30 to 40 seconds of the green passage light 24 being on) before the change occurred in the duty cycle, the digital display would change from a red digital display of "1" (to indicate the final remaining second of the red stop light 20) to a "30" to indicate thirty seconds remaining (total time) of the green passage light 24.

When the duty cycle changes, the digital display would change from a red digital display of "1" (to again indicate the final remaining second of the red stop light 20) to a "40" to indicate now that forty seconds remain (total time) of the green passage light 24. The driver need not be informed of the change in duty cycle other than by seeing a change in the remaining time.

However, there are also in use on-demand types of signaling devices (not shown) in which the duty cycle can abruptly change based on changing traffic conditions and patterns. For example, let us assume that the signal assembly 12 is an on-demand type of a signaling device which will normally provide for thirty seconds of the green passage light 24 being illuminated and that twenty seconds of that time remain. Let us assume that there is no traffic passing through the intersection to use that green passage light (as is communicated to the signaling device by whatever sensing means (not shown) is attached thereto, as is also commonly known in the arts.

Let us further assume that a first driver (not shown) is approaching the intersection and believes that he has ample time (twenty seconds) to pass through the intersection, as shown by the digital display 18. Let us also assume that a second driver (not shown) has approached the same intersection ahead of the first driver but in a perpendicular direction. The sensing means of the signaling device detects the presence of the second driver and this condition results in the signaling device abruptly reducing the amount of remaining "green" time for the first driver.

Depending upon the internal logic of the signal assembly 12 (i.e., the signaling device) that time could abruptly change from twenty seconds of time remaining to only a few seconds. In the most extreme of situations it could abruptly change from twenty seconds of green time remaining to none at all (i.e., an instant change to yellow).

If the first driver is unaware of this potential change he could conceivably glance at the digital display 18 and see twenty seconds of time remaining. He might then fail to carefully monitor the digital display 18 or the signal assembly 12 and pass through the intersection most inappropriately.

To prevent this from occurring the input signal 60 also must inform the microprocessor 58 as to the operating mode that the signal assembly 12 is in, for example, if it is in an "on-demand" mode of operation. This information must in turn be conveyed to the driver.

When the signal assembly 12 is in the normal mode of operation, that is to say when the remaining time until a change of state occurs will not abruptly change, the digital display 18 will display the remaining time in digits that remain steadily illumined.

For example, if there are twenty seconds of green passage time remaining and no sudden change can occur, the digital display 18 will indicate "20" in green digits that remain steadily on until it changes from a "20" to a "19".

When the signal assembly 12 is in the on-demand mode of operation, that is to say when the remaining time until a change of state occurs can abruptly change, the digital display 18 will display the remaining time in digits that flash while illumined.

For example, if there are twenty seconds of green passage time remaining and this length of time can abruptly be curtailed, the digital display 18 will indicate "20" in green digits that are flashing on and off a number of times per second. The first driver, according to the above example, then knows that although the display indicates that there are twenty remaining seconds, that this length of time is in fact subject to change.

The digital display 18 could change from a flashing green "20" to a flashing green "19" as one would normally expect, or it might change to a flashing yellow "3" as a result of an on-demand type of a response being initiated by the control logic of the signal assembly 12. This would be in response to the detection of approaching traffic that is traveling in a different direction.

The flashing of the digits attracts the attention of the driver so that he is more likely to pay attention and to notice an immediate change in the digital display 18.

An alternate method to show that the remaining time is subject to sudden change is by the addition of a flashing caution light 30 attached to the count-down indicator 16. The flashing caution light 30 is normally off unless the mode of operation of the signal assembly 12 is "on-demand" and therefore subject to abrupt changes.

The flashing caution light 30 is preferably yellow in color.

Whenever there is a power failure in the alternating current supplied, the backup battery 50 continues to supply all electrical power necessary to sustain operation of the traffic light 10 for a predetermined period of time.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A traffic light, comprising:

(a) a signal assembly, said signal assembly including a red stop light indicator, a green passage light indicator, and an amber caution light indicator; and (b) a count down indicator, said count-down indicator including a digital display that is adapted to display a remaining time until the next change of state of said signal assembly wherein said remaining time that is displayed by said digital display is adapted to decrement in accordance with the number of seconds that are remaining until the next change of state occurs, and wherein said remaining time that is displayed by said digital display includes at least one digit that includes a color that corresponds to the color of said indicator that is presently being illuminated by said signal assembly, and wherein said digital display is disposed proximate to said signal assembly.

2. The traffic light of claim 1 including means for controlling said digital display, said means for controlling including a microprocessor.

3. The traffic light of claim 1 including a backup battery, said backup battery adapted to supply power to said traffic light during an electrical power outage.

4. The traffic light of claim 3 including a solar panel attached proximate to said traffic light, said solar panel adapted to convert sunlight into electrical energy sufficient to supply electrical energy to said backup battery.

5. The traffic light of claim 1 including means for indicating a potential for a non-sequential change to said remaining time.

6. The traffic light of claim 5 wherein said means for indicating includes means for flashing said digital display.

7. The traffic Light of claim 6 wherein said means for flashing flashes said digital display on and off a plurality of times per second.

8. The traffic light of claim 5 wherein said means for indicating includes a flashing caution light disposed proximate to said digital display.

9. The traffic light of claim 8 wherein said flashing caution light flashes on and off at a predetermined rate.

10. The traffic light of claim 1 wherein said at least one digit of said digital display is red in color when said stop light indicator is illuminated and wherein said remaining time that is displayed by said digital display is adapted to decrement in accordance with the number of seconds that are remaining until said stop light indicator is extinguished and said green passage light indicator is illuminated.

11. The traffic light of claim 1 wherein said at least one digit of said digital display is green in color when said green passage light indicator is illuminated and wherein said remaining time that is displayed by said digital display is adapted to decrement in accordance with the number of seconds that are remaining until said green passage light indicator is extinguished and said amber caution light indicator is illuminated.

12. The traffic light of claim 1 wherein said at least one digit of said digital display is amber in color when said caution light indicator is illuminated and wherein said remaining time that is displayed by said digital display is adapted to decrement in accordance with the number of seconds that are remaining until said amber caution light indicator is extinguished and said red stop light indicator is illuminated.

13. The traffic light of claim 1 wherein said amber caution light includes a yellow color.

14. The traffic light of claim 1 wherein said amber caution light includes an orange color.

15. The traffic light of claim 1 wherein said traffic light includes an on-demand mode of operation whereby, when said traffic light is in said on-demand mode of operation, said remaining time until the next anticipated change of state is subject to change from said remaining time to no further remaining time subsequent to said traffic light detecting the presence of an object and wherein when said traffic light is in said on-demand mode of operation said traffic light includes means for visually indicating that said traffic light is in said on-demand mode of operation.

16. The traffic light of claim 15 wherein said means for visually indicating that said traffic light is in said on-demand mode of operation includes means adapted for flashing said digital display on and off at a predetermined rate.

17. The traffic light of claim 15 wherein said means for visually indicating that said traffic light is in said on-demand mode of operation includes means adapted for flashing said digital display on and off at a predetermined rate.

18. A traffic light, comprising:

(a) a signal assembly, said signal assembly including a red stop light indicator, a green passage light indicator, and an amber caution light indicator; and (b) a count down indicator, said count-down indicator including a digital display that is adapted to display a remaining time until the next change of state of said signal assembly wherein said remaining time that is displayed by said digital display is adapted to decrement in accordance with the number of seconds that are remaining until the next anticipated change of state occurs, and wherein said remaining time that is displayed by said digital display includes at least one digit that includes a color that corresponds to the color of said indicator that is presently being illuminated by said signal assembly, and wherein said digital display is disposed proximate to said signal assembly, and wherein said traffic light includes an on-demand mode of operation whereby, when said traffic light is in said on-demand mode of operation, said remaining time until the next anticipated change of state is subject to change from said remaining time to no further remaining time subsequent to said traffic light detecting the presence of an object and wherein when said traffic light is in said on-demand mode of operation said traffic light includes means for visually indicating that said traffic light is in said on-demand mode of operation.

* * * * *